United States Patent [19]

Kwasnitza

[11] 4,216,954

[45] Aug. 12, 1980

[54] APPARATUS FOR DIVERTING PAPER SHEETS OR THE LIKE FROM A FIRST PATH INTO A SECOND PATH

[75] Inventor: Hans-Dieter Kwasnitza, Neuffen, Fed. Rep. of Germany

[73] Assignee: De La Rue Giori S.A., Lausanne, Switzerland

[21] Appl. No.: 910,090

[22] Filed: May 26, 1978

[30] Foreign Application Priority Data

Jun. 7, 1977 [DE] Fed. Rep. of Germany ..... 2725546

[51] Int. Cl.[2] ..... B65H 29/60

[52] U.S. Cl. ..... 271/283; 271/196; 271/276

[58] Field of Search ..... 271/94–96, 271/195, 196, 276, 64, 283

[56] References Cited

U.S. PATENT DOCUMENTS

| | | | |
|---|---|---|---|
| 2,867,438 | 1/1959 | Hori | 271/196 |
| 3,178,179 | 4/1965 | MacLean | 271/196 |
| 3,197,200 | 7/1965 | Burt | 271/196 X |
| 3,533,618 | 10/1970 | Carstens | 271/276 |
| 4,030,607 | 6/1977 | Suda et al. | 271/64 X |
| 4,073,487 | 2/1978 | Schirrmeister et al. | 271/64 |

*Primary Examiner*—Robert W. Saifer
*Attorney, Agent, or Firm*—Kane, Dalsimer, Kane, Sullivan and Kurucz

[57] ABSTRACT

Apparatus for moving discrete sheets along a first path has a rotary hollow cylindrical foraminous barrel which is located below a portion of the first path and is adjacent to the inlet of a second path along which selected sheets move when a chamber which is rotatable relative to and is located in the interior of the barrel is connected with a suction generating device. The chamber reaches the first path at the inlet of the second path together with the leaders of successive sheets and can be connected with the suction generating device by a solenoid-operated valve which is actuated by a switch which, in turn, is actuated by an adjustable cam on the rotary core which defines the chamber. When the chamber is sealed from the suction generating device, it is connected with a source of slightly compressed air so that streamlets of air which issue from the barrel compel successive sheets to remain in the first path. The barrel is rotated at a peripheral speed which matches the speed of the conveyors of the transporting systems defining the first and second paths, preferably by a belt conveyor which is adjacent to a part of the first path as well as to a part of the second path.

14 Claims, 2 Drawing Figures

APPARATUS FOR DIVERTING PAPER SHEETS OR THE LIKE FROM A FIRST PATH INTO A SECOND PATH

BACKGROUND OF THE INVENTION

The present invention relates to apparatus for moving discrete paper sheets or analogous commodities, and more particularly to improvements in apparatus which can move successive sheets along a first path and include means for diverting selected sheets from the first path into a second path.

The need for diverting certain sheets of a succession of rapidly advancing discrete sheets from a first path into a second path arises in many types of paper processing and like machines, e.g., to ssegregate unsatisfactory sheets from acceptable sheets, to break up a continuous stream of discrete sheets into two or more streams, or to divert sheets to an inspecting station at regular or randomly selected intervals.

In presently known sheet moving apparatus, the means for diverting selected sheets from a portion of a first path into a second path includes mechanical deflecting or diverting devices. For example, it is known to employ mechanical switching devices similar to railroad switches which can be pivoted or otherwise moved into the path of an oncoming sheet to divert the oncoming sheet (or the oncoming sheet and one or more next-following sheets) into a second path. Certain other types of presently known diverting devices resemble or constitute rollers or drums having portions of larger and smaller radius. The portion or portions of smaller radius permit successive sheets to advance along a first path, and the portion or portions of larger radius divert the oncoming sheet or sheets into a second path.

A drawback of mechanical diverting devices is that they cannot be employed when the sheets are transported at a high or extremely high speed because a mechanical part which is introduced into the path of an oncoming rapidly advancing sheet is likely to deface and/or otherwise damage the leader of the oncoming sheet. Moreover, the inertia of mechanical diverting devices is relatively high so that they cannot be introduced between a preceding sheet and an oncoming sheet when the sheets are transported at an elevated speed, especially if the width of clearances or gaps between neighboring sheets is negligible.

OBJECTS AND SUMMARY OF THE INVENTION

An object of the invention is to provide a novel and improved apparatus which can reliably divert selected sheets from a first path into a second path regardless of the speed at which the sheets advance along the first path and irrespective of the width of clearances between successive sheets.

Another object of the invention is to provide an apparatus of the above outlined character wherein the diverting means is constructed and assembled in such a way that the sheets are treated gently, i.e., that neither the leader nor any other part of a diverted sheet is deformed and/or otherwise damaged, and that diverted sheets cannot interfere with the progress of non-diverted sheets along the first path.

A further object of the invention is to provide novel and improved sheet diverting means for use in an apparatus wherein successive sheets of a series of discrete sheets are normally moved along a first path but wherein certain sheets or series of sheets must be diverted into a second path.

An additional object of the invention is to provide relatively simple and compact diverting means which can be installed in many existing sheet moving apparatus as a superior substitute for conventional diverting means, such as the aforedescribed mechanical diverting devices.

An ancillary object of the invention is to provide novel and improved means for preventing the diversion of those sheets which are supposed to advance along the first path.

One feature of the invention resides in the provision of an apparatus for moving discrete paper sheets or analogous commodities. The apparatus comprises transporting means including conveyor means (e.g., several endless belt conveyors) for advancing successive commodities along a first path (e.g., along a horizontal path), means (e.g., a second transporting system including several endless belt conveyors) defining a second path having an inlet which is adjacent to a predetermined portion of the first path (for example, the second path can slope downwardly so that the inlet constitutes its upper end portion and is disposed at the underside of the first path), and means for diverting selected commodities from the first path into the second path. The diverting means includes a hollow cylindrical foraminous barrel extending transversely of the first and second paths and being adjacent to the predetermined portion of the first path and to the inlet of the second path (the barrel is preferably mounted at a level below the first path). The barrel is rotated in the direction of movement of commodities along the first path and is driven (e.g., by an endless belt conveyor of the first and/or second transporting means) at a peripheral speed which at least closely approaches but preferably matches the speed of the conveyor means of the transporting means. The diverting means further comprises suction generating means (e.g., a vacuum pump), and means for connecting the interior of the hollow barrel (preferably a chamber which occupies only a small portion of the interior of the barrel) with the suction generating means not later than when a selected commodity enters the predetermined portion of the first path whereby the foraminous barrel attracts the selected commodity and diverts such comodity into the inlet of the second path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
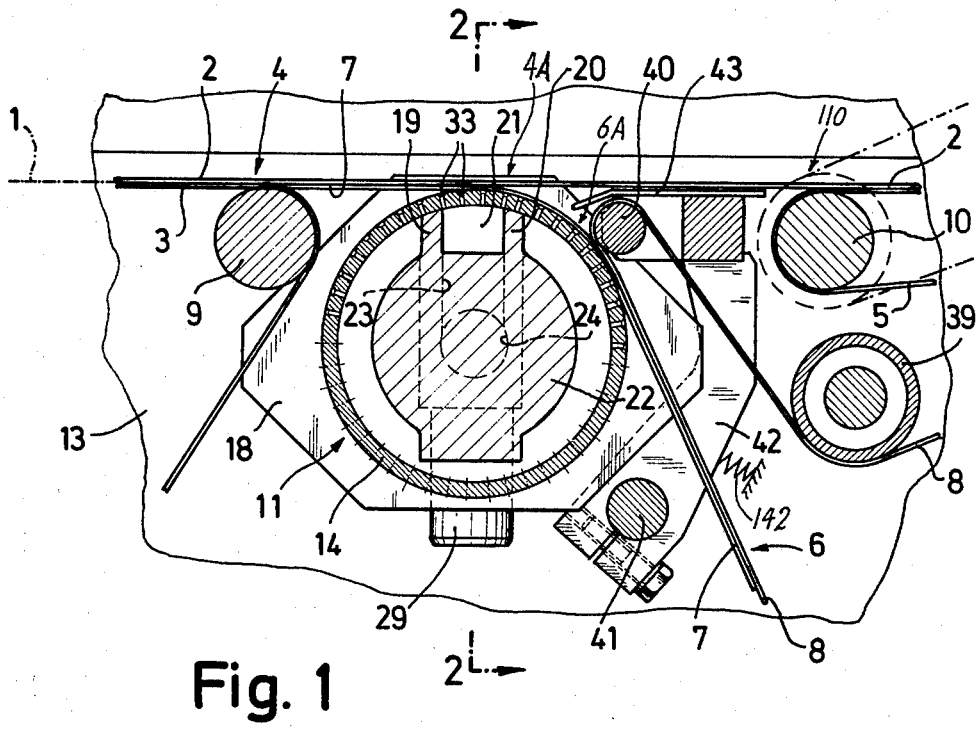
FIG. 1 is a transverse vertical sectional view of an apparatus which embodies one form of the invention.

FIG. 1 shows an apparatus which can move successive paper sheets 1 along a first path 4 or along a second path 6 which has an inlet 6A adjacent a portion 4A of the first path. The first path 4 is defined by a first transporting system including an upper belt conveyor 2, a first lower belt conveyor 3, a second lower belt conveyor 5, and a platform or table 43 which is disposed between the upper reaches of the belt conveyors 3 and 5. The path 4 is horizontal and its upper side is bounded by the lower reach of the belt conveyor 2. The conveyors 2, 3 and 5 are driven to advance at the same speed, and the upper reaches of the conveyors 3, 5 bear against the lower reach of the conveyor 2 so that a sheet 1 which is admitted into the first path 4 between the conveyors 2, 3 is caused to advance in a direction to the right, as viewed in FIG. 1, to thereupon move along the upper side of the platform 43 and finally between the conveyors 2, 5. The underside of the aforementioned portion 4A of the path 4 is open in the region between a guide roller 9 for the conveyor 3 and the left-hand end of the platform 43. Successive sheets 1 are fed between the belt conveyors 2 and 3 at intervals, i.e., the trailing end of each preceding sheet 1 is spaced apart (separated by a clearance or gap) from the leader of the next-following sheet.

Figure 2:
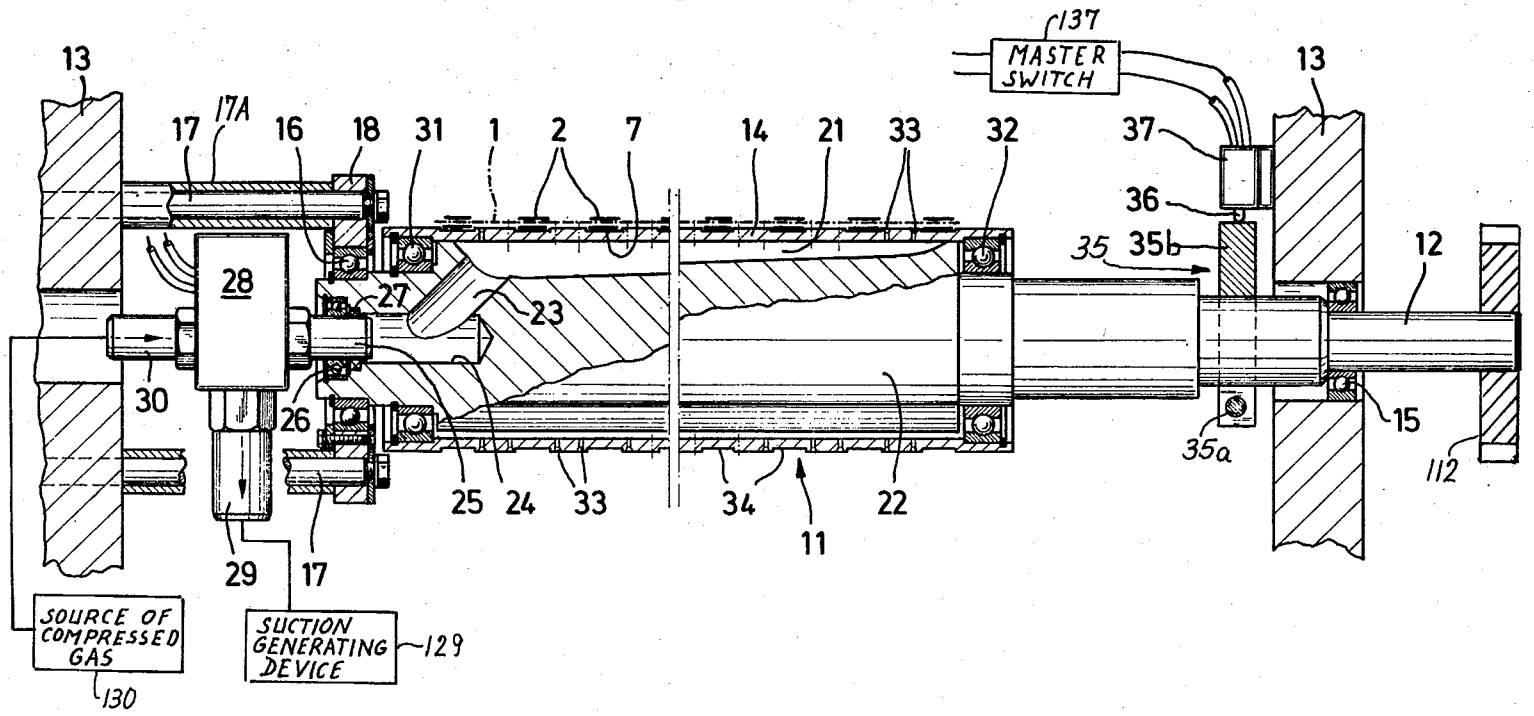
FIG. 2 is a smaller-scale sectional view as seen in the direction of arrows from the line 2—2 of FIG. 1.

In the embodiment of FIG. 1, the second path 6 makes an acute angle with that portion of the first path 4 which is defined by the belt conveyors 2, 5 and platform 43, and the second path 6 slopes downwardly, i.e., to the right and downwardly form the aformentioned open side of the portion 4A of the path 4. The path 6 is defined by the belt conveyors 7, 8 of a second transporting system. The platform 43 extends close to the left-hand guide roller 10 for the belt conveyor 5. FIG. 2 shows that each of the conveyors 2, 7 comprises several endless flexible elements.

In accordance with a feature of the invention, the apparatus further comprises novel and improved means for diverting selected sheets 1 from the portion 4A of the path 4 into the inlet 6A of the path 6. The diverting means includes a rotary suction-operated device 11 which is disposed between the guide roller 9 and the platform 43 and is immediately adjacent to the open side of the portion 4A of the path 4 as well as to the inlet 6A of the path 6. The axis of the device 11 extends transversely of the paths 4 and 6, i.e.,the device 11 is rotatable about a horizontal axis extending at right angles to the plane of FIG. 1. The device 11 comprises a rotary member or core 22 having a shaft 12 one end portion of which extends well beyond the respective end of a hollow foraminous cylindrical sleeve or barrel 14 of the device 11 and is rotatable in the inner race of an antifriction ball bearing 15 mounted in a stationary frame member 13 shown in the right-hand portion of FIG. 2. The apex of the barrel 14 contacts successive sheets 1 in the first path 4, i.e., successive sheets 1 which advance along the portion 4A of the path 4 contact the barrel 14 at the twelve o'clock position, as viewed in FIG. 1.

The shaft 12 forms an integral or detachable part of the rotary member or core 22 which latter is surrounded by the barrel 14 and the left-hand end portion of which, as viewed in FIG. 2, is surrounded by the inner race of an antifriction ball bearing 16 mounted in a bearing plate 18 which is fixedly secured to a second frame member 13 (shown in the left-hand portion of FIG. 2) by connecting elements 17 in the form of bolts surrounded by distancing sleeves 17*a*. The rotary member or core 22 is a solid cylinder which is provided with two substantially parallel extensions or partitions 19, 20 whose outer end faces are closely adjacent to the internal surface of the barrel 14 (see FIG. 1). The partitions 19, 20 extend in parallelism with the axis of the device 11 and flank an elongated chamber 21 which extends substantially along the full length of the barrel 14 (see FIG. 2). The partitions 19 and 20 separate the chamber 21 from the annular space between the periphery fo the major portion of the rotary member or core 22 and the internal surface of the barrel 14. The left-hand end of the suction chamber 21 (as viewed in FIG. 2) communicates with a passage or channel 23 which is machined into the member 22 and further communicates with an axially extending blind bore 24 in the left-hand end face of the core. The outer end portion of the blind bore 24 receives a stationary tubular nipple 25 which is surrounded by an antifriction ball bearing 26 and a sealing ring 27 located inwardly of the bearing 26 and serving to seal the bore 24 from the atmosphere. The sealing ring 27 engages the internal surface bounding the bore 24 and the periperhal surface of the stationary nipple 25.

The nipple 25 defines one port of a solenoid-operated three-way valve 28 which is installed in the space between the rotary member 22 and the left-hand frame member 13 of FIG. 2 and has a second port defined by a tubular nipple 29 which is connected to a suitable suction generating device 129 (e.g., a vacuum pump), and a third port defined by a nipple 30 which is connected with an accumulator 130 or another suitable source of slightly compressed gaseous fluid. The valve 28 can connect the port of the nipple 25 with the port of the nipple 29 or 30.

The end portions of the barrel 14 rotate with the outer races of two antifriction ball bearings 31, 32 which are mounted on the rotary member or core 22. The barrel 14 has a large number of radial ports 33 which discharge streamlets of compressed gas (normally air) when the chamber 21 is connected with the source 130 via nipples 30, 25 (the chamber 21 then constitutes a plenum chamber) and which draw air into the chamber 21 when the latter is connected with the suction generating device 129 via nipples 29, 25. The peripheral surface of the barrel 14 is further formed with circumferential grooves 34 for the belts of the conveyor 7 of the second transporting system. The barrel 14 is actually a guide which causes the belts of the conveyor 7 to change the direction of their movement from a first direction (identical with the direction of movement of the upper reaches of the belts of the conveyor 2) to a second direction (identical with the direction of movement of sheets 1 along the path 6).

The shaft 12 or the adjacent portion of the rotary member 22 carries a cam-shaped actuator or trip 35 which can intermittently depress the movable contact 36 of an electric switch 37 which is or can be connected in circuit with the solenoid of the electromagnetic valve 28. The actuator 35 is normally fixed to and shares all angular movements of the rotary member 22; however, it is releasably secured to the member 22 by a screw 35*a* which enables an attendant to change the angular position of the lobe 35*b* of the actuator 35 with respect to the member 22 and to thus change the angular position of the lobe relative to the chamber 21. A master switch 137 is connected between the solenoid of the valve 28 and the switch 37; when the master switch 137 is closed, each revolution of the member 22 can entail an energization of the solenoid and actuation of the valve 28 in order to connect the chamber 21 with the suction generating device 129 via nipple 29. The connection is established (a) as long as the lobe 35*b* maintains the switch 37 in the closed position or (b) as long as the master switch 137 remains closed.

The conveyor 8 which flanks one side of the second path 6 is trained over guide rollers 39 and 40. The shaft of the roller 39 is mounted in the housing or frame of the apparatus (such housing includes the aforementioned frame members 13 and the bearing plate 18). The shaft of the roller 40 is mounted on a lever 42 which is pivotable on or with and adjustable relative to a shaft 41 and is biased in a counterclockwise direction as viewed in FIG. 1, by one or more springs 142. Thus, the spring or springs 142 cause the roller 40 to bear against the peripheral surface of the barrel 14 at a level slightly below the path 4, namely, in the region of the inlet 6A. The aforementioned platform or table 43 is attached to the lever 42 adjacent to the guide roller 40 for the belt or belts 8. The roller 10 for the conveyor 5 receives torque from a drive 110. The drive means for the conveyors 2, 3, 7 and 8 are not shown.

The operation is as follows:

The barrel 14 is rotated by the belts of the conveyor 7 so that its peripheral speed matches the speed of the belt conveyors 2, 3, 5, 7 and 8, i.e., the speed of movement of successive sheets 1. Also, the barrel 14 rotates clockwise, as viewed in FIG. 1, i.e., in the direction of movement of sheets 1 along the path 4. The rotary member 22 is driven at such a speed that it completes one revolution during transport of a sheet 1 along the device 11. Such synchronization of the RPM of the shaft 12 with the rate of transport of sheets 1 along the path 4 can be readily achieved by driving a gear 112 (or pulley or sprocket wheel) on the shaft 12 in synchronism with drive means for a transverse cutter, not shown, which intermittently severs a continuous web of paper or the like to subdivide the web into a succession of discrete sheets 1. The just described mode of rotating the shaft 12 (and hence the rotary member 22 and the suction chamber 21) is but one of many possible ways of insuring that the member 22 completes one revolution while a sheet 1 in the path 4 advance through a distance which equals the distance between the leading edges of two neighboring sheets. It will be noted that the RPM of the barrel 14 is a function of the speed of movement of the sheets 1, of the length of the sheets 1 and of the width of clearances or gaps between neighboring sheets, whereas the RPM of the member 22 is merely a function of the frequency at which successive sheets 1 are advanced past the inlet 6A but is independent of the length of the sheets and/or the width of gaps between neighboring sheets.

The orientation of the chamber 21 is selected in such a way that it is located at the twelve o'clock position, as viewed in FIG. 1, when the leader of a sheet 1 reaches the apex of the barrel 14.

If the sheets 1 are to be transported along the first path 4, i.e., between the conveyors 2, 3, along the apex of the barrel 14, between the conveyor 2 and the platform 43 and thereupon between the conveyors 2 and 5, the master switch 137 is opened whereby the valve 28 connects the nipple 25 with the nipple 30, i.e., the chamber 21 is connected with the source 130 of compressed gas (the pressure of such gas need not appreciably exceed the atmospheric pressure) whereby the streamlets of air which issue from the ports 33 of the barrel 14 compel successive sheets 1 to remain in the path 4 during travel past the barrel 14.

When one or more sheets 1 are to be diverted from the portion 4A of the path 4 into the inlet 6A of the second path 6, the master switch 137 is closed so that the valve 28 connects the chamber 21 with the suction generating device 129 via port of the nipple 29 during each revolution of the core 22, namely, as long as the lobe 35*b* of the actuator 35 maintains the switch 37 in closed position or as long as the master switch 137 remains closed. The chamber 21 then attracts the leader of the oncoming sheet 1 to the periphery of the barrel 14 and the latter diverts the leader into the inlet 6A of the path 6. The thus deflected sheet 1 continues to move along the path 6 as soon as its leader is engaged by the conveyors 7 and 8, even if the chamber 21 remains connected to the suction generating device 129 via nipple 29.

It is preferred to select the timing of connection of the chamber 21 to the suction generating device 129 in the following way: When the master switch 137 is closed, the actuator 35 closes the switch 37 as soon as the chamber 21 is moved sufficiently beyond the twelve o'clock position (e.g., to the one o'clock position, as viewed in FIG. 1) so that it cannot attract the trailing end of a sheet which advances toward and along the upper side of the platform 43. This renders it possible to evacuate air from the chamber 21 while the chamber continues to rotate clockwise, as viewed in FIG. 1, i.e., the pressure in the chamber 21 is sufficiently low to insure reliable deflection of the leader of an oncoming selected sheet 1 when the chamber 21 reaches or approaches the twelve o'clock position. The conveyor 7 automatically strips the leader of the deflected sheet 1 off the peripheral surface of the barrel 14 as soon as such leader enters the inlet 6A of the path 6, i.e., suction in the chamber 21 need not collapse immediately after the leader of an oncoming selected sheet is diverted into the path 6. The pressure in the chamber 21 can begin to rise as soon as the leader of the diverted sheet 1 enters between the belts 7 and 8. Such rise of pressure in the chamber 21 can take place in response to opening of the master switch 137, i.e., the chamber 21 then communicates with the source 130 of compressed gas via nipple 30. The switch 37 can constitute a pulse generator whose pulses alternately energize and deenergize the solenoid of the electromagnetic valve 28. This insures that the buildup of pressure in and the evacuation of air from the chamber 21 invariably take place in one and the same angular position of the rotary member 22 and chamber 21. It would also suffice to connect the chamber 21 with the atmosphere as soon as the diversion of a selected sheet 1 (or of a series of successive selected sheets) into the path 6 is completed. The provision of a source of compressed gas is desirable and advantageous because it insures that the pressure in the chamber 21 rises practically instantaneously as soon as the chamber is disconnected from the port of the nipple 29.

The apparatus can be used for diversion of single sheets at regular or randomly selected intervals, or for diversion of any desired number of successive sheets.

The improved apparatus can be used for diversion of selected sheets 1 from the portion 4A of the first path 4 into the inlet 6A of the second path 6 by utilizing a suction chamber which occupies or constitutes the entire interior of the barrel 14 and by establishing communication between the interior of the barrel 14 and the suction generating means 129 when the leader of a selected sheet 1 approaches that portion (4A) of the first path 4 which is adjacent to the inlet 6A. Thus, the nipple 25 could extend into an end wall of the barrel 14 and could constitute a stub shaft on which the barrel rotates. The valve 28 would be actuated to initiate the evacuation of air from the entire interior of the barrel 14 whenever the leader of a selected sheet 1 enters the portion 4A of the first path, i.e., as soon as the preceding sheet (which should continue to advance along the path 4) is entrained by the conveyors 2, 5 to insure that its progress cannot be interrupted and/or otherwise affected by air streams which flow through the ports 33 and into the interior of the barrel 14 when the valve 28 (or an analogous valve) is actuated to connect the interior of the barrel with the suction generating means 129.

However, the provision of the rotary member or core 22 is preferred at this time because the establishment of requisite subatmospheric pressure can be completed almost instantaneously. Furthermore, it suffices to employ a simpler and smaller suction generating device whose energy requirements are low because the partitions 19, 20 of the rotary member 22 seal the suction chamber 21 from the remaining (unoccupied) portion of the interior of the barrel 14. The outer side of the suction chamber 21 is open at the inner side of the barrel 14; however, it will be understood that the entire outer side of the chamber 21 need not be open, i.e., the rotary member or core 22 may comprise a perforated wall or screen which overlies the radially outermost part of the chamber 21 and is immediately adjacent to the internal surface of the barrel 14.

The provision of a suction chamber whose width, as considered in the circumferential direction of the barrel 14, is only a small fraction of the entire circumference of the barrel brings about another important advantage, namely, there is ample time to change the pressure in the chamber 21 during each revolution of the rotary member or core 22 without influencing the movement of sheets 1 along the path 4. In other words, the pressure in the chamber 21 can be raised or reduced practically immediately after the chamber advances beyond the twelve o'clock position in FIG. 1. Furthermore, by driving the rotary member 22 in synchronism with the movement of conveyors 2, 3, 5 in the transporting system which defines the path 4 so that the member 22 completes one revolution while a sheet 1 advances through a distance equaling that between the leading edges of two neighboring sheets in the path 4, it is possible to accurately time the arrival of the chamber 21 to the path portion 4A so that such arrival coincides with arrival of the leader of a sheet which is to be diverted into the inlet 6A of the path 6. Such timing can be adjusted by changing the angular position of the trip 35 with respect to the rotary member 22.

The switch 137 can be actuated by hand or by a timer to divert sheets at random or at preselected intervals. Examination of samples at regular or irregular intervals is desirable when the sheets which are introduced into the first path 4 are provided with printed matter. The quality of prints is likely to be inferior when the printer is operated at a reduced speed.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for moving discrete paper sheets or analogous commodities, comprising transporting means including conveyor means for advancing successive commodities along a first path; means defining a second path having an inlet adjacent a predetermined portion of said first path; means for diverting selected commodities from said first path into said second path, including a hollow cylindrical foraminous barrel extending transversely of said paths adjacent said portion of said first path and said inlet of said second path, said barrel being arranged to rotate in the direction of advancement of sheets along said first path and at a peripheral speed at least approximately the speed of said conveyor means, suction generating means, and means for connecting the interior of said barrel with said suction generating means not later that when a selected commodity enters said portion of said first path whereby said barrel attracts such selected commodity and diverts the selected commodity into the inlet of said second path; a member defining a chamber, said member being disposed in the interior of and being rotatable with respect to said barrel, said chamber having an open side which is at least partly open and is adjacent the internal surface of said barrel, said member occupying a portion of the interior of said barrel and including partitioning means for sealing said chamber from the unoccupied portion of the interior of said barrel, said connecting means comprising a valve having ports communicating with said chamber and said suction generating means, and means for actuating said valve to connect said chamber with said suction generating means not later than when a selected commodity enters said portion of said first path; and means for rotating said member at the rate of one revolution for each commodity which advances along said portion of said first path.

2. Apparatus as defined in claim 1, wherein said chamber extends lengthwise of and substantially along the full length of said barrel.

3. Apparatus as defined in claim 1, further comprising stationary frame means, said member having end portions rotatably journalled in said frame means.

4. Apparatus as defined in claim 1, wherein said member has an axial bore communicating with said chamber, said connecting means including a tubular portion sealingly extending into said bore.

5. Apparatus as defined in claim 1, wherein the width of said chamber, as considered in the circumferential direction of said barrel, is a small fraction of the entire circumference of said barrel.

6. Apparatus as defined in claim 1, wherein said connecting means comprises a valve actuatable to connect said chamber with said suction generating means and means for actuating said valve including a trip rotating with said member.

7. Apparatus for moving discrete paper sheets or analogous commodities, comprising transporting means including conveyor means for advancing successive commodities along a first path; means defining a second path having an inlet adjacent a predetermined portion of said first path; means for diverting selected commodities from said first path into said second path, including a hollow cylindrical foraminous barrel extending transversely of said paths adjacent said portion of said first path and said inlet of said second path, said barrel being arranged to rotate in the direction of advancement of sheets along said first path and at a peripheral speed at least approximately the speed of said conveyor means, and means for connecting the interior of said barrel with said suction generating means not later than when a selected commodity enters said portion of said first path whereby said barrel attracts such selected commodity and diverts the selected commodity into the inlet of said second path; and a member defining a chamber, said member being disposed in the interior of and being rotatable with respect to said barrel, said chamber having an open side which is at least partly open and is adjacent the internal surface of said barrel, said connecting means comprising a valve actuable to connect said chamber with said suction generating means and means for actuating said valve including a trip rotating with said member.

8. Apparatus as defined in claim 6 or 7, wherein said valve is an electromagnetic valve and said actuating means further comprises a switch in circuit with said valve and operable by said trip.

9. Apparatus as defined in claim 8, wherein said trip is a cam secured to said member.

10. Apparatus as defined in claim 8, wherein said actuating means further comprises a second switch connected between said first mentioned switch and said valve.

11. Apparatus as defined in claim 1, further comprising means for rotating said member through one revolution for each sheet which is advanced along said portion of said first path so that said chamber is adjacent to said portion of said first path whenever the leader of a commodity enters such portion, said connecting means including a valve and means for actuating said valve to connect said chamber with said suction generating means before said chamber reaches said portion of said first path while the leader of a selected sheet is advanced toward said portion of said first path.

12. Apparatus for moving discrete paper sheets or analogous commodities, comprising transporting means including conveyor means for advancing successive commodities along a first path; means defining a second path having an inlet adjacent a predetermined portion of said first path; means for diverting selected commodities from said first path into said second path, including a hollow cylindrical foraminous barrel extending transversely of said paths adjacent said portion of said first path and said inlet of said second path, said barrel being arranged to rotate in the direction of advancement of sheets along said first path and at a peripheral speed at least approximately the speed of said conveyor means, suction generating means, and means for connecting the interior of said barrel with said suction generating means not later than when a selected commodity enters said portion of said first path whereby said barrel attracts such selected commodity and diverts the selected commodity into the inlet of said second path; a member defining a chamber, said member being disposed in the interior of and being rotatable with respect to said barrel, said chamber having an open side which is at least partly open and is adjacent the internal surface of said barrel; and means for rotating said member through one revolution for each sheet which is advanced along said portion of said first path so that said chamber is adjacent to said portion of said first path whenever the leader of a commodity enters such portion, said connecting means including a valve and means for actuating said valve to connect said chamber with said suction generating means before said chamber reaches said portion of said first path while the leader of a selected sheet is advanced toward said portion of said first path.

13. Apparatus as defined in claim 12 wherein said acutating means further comprises means for actuating said valve to seal said suction generating means from said chamber as soon as the leader of a selected sheet enters said inlet of said second path.

14. Apparatus for moving discrete paper sheets or analogous commodities, comprising transporting means including conveyor means for advancing successive commodities along a first path; means defining a second path having an inlet adjacent a predetermined portion of said first path; means for diverting selected commodities from said first path into said second path, including a hollow cylindrical foraminous barrel extending transversely of said paths adjacent said portion of said first path and said inlet of said second path, said barrel being arranged to rotate in the direction of advancement of sheets along said first path and at a peripheral speed at least approximately the speed of said conveyor means, suction generating means, and means for connecting the interior of said barrel with said suction generating means not later than when a selected commodity enters said portion of said first path whereby said barrel attracts such selected commodity and diverts the selected commodity into the inlet of said second path; a member defining a chamber, said member being disposed in the interior of and being rotatable with respect to said barrel, said chamber having an open side which is at least partly open and is adjacent the internal surface of said barrel; and means for rotating said member at the rate of one revolution for each commodity which advances along said portion of said first path.

* * * * *

UNITED STATES PATENT AND TRADEMARK OFFICE

CERTIFICATE OF CORRECTION

PATENT NO. : 4,216,954

DATED : August 12, 1980

INVENTOR(S) : Hans-Dieter Kwasnitza

It is certified that error appears in the above—identified patent and that said Letters Patent is hereby corrected as shown below:

Column 1, line 16, "ssegregate" should be --segregate--

Column 10, claim 13, line 21, after "claim" insert --11 or--.

Signed and Sealed this

*Sixteenth* Day of *December 1980*

[SEAL]

*Attest:*

SIDNEY A. DIAMOND

*Attesting Officer*

*Commissioner of Patents and Trademarks*